US010626818B2

(12) United States Patent
Nose et al.

(10) Patent No.: US 10,626,818 B2
(45) Date of Patent: Apr. 21, 2020

(54) CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventors: Yuki Nose, Kasugai (JP); Keiichi Myojo, Okazaki (JP); Yoshiyuki Shogenji, Toyota (JP); Eiji Ikuta, Obu (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 16/013,158

(22) Filed: Jun. 20, 2018

(65) Prior Publication Data

US 2019/0024596 A1 Jan. 24, 2019

(30) Foreign Application Priority Data

Jul. 21, 2017 (JP) ..... 2017-141733

(51) Int. Cl.
*F02D 41/14* (2006.01)
*F02D 41/00* (2006.01)
(Continued)

(52) U.S. Cl.
CPC ..... *F02D 41/1408* (2013.01); *F02D 41/0085* (2013.01); *F02D 41/1454* (2013.01);
(Continued)

(58) Field of Classification Search
CPC ..... F02D 41/00; F02D 41/0085; F02D 41/14; F02D 41/1408; F02D 41/1454;
(Continued)

(56) References Cited

U.S. PATENT DOCUMENTS 5,845,492 A 12/1998 Isobe et al.
6,470,854 B1 * 10/2002 Hirata ..... F02D 31/005 123/436
(Continued)

FOREIGN PATENT DOCUMENTS

DE 10 2008 051 820 A1 4/2010
EP 3 029 309 A1 6/2016
(Continued)

*Primary Examiner* — John Kwon
*Assistant Examiner* — Johnny H Hoang
(74) *Attorney, Agent, or Firm* — Finnegan, Henderson, Farabow, Garrett & Dunner, LLP

(57) ABSTRACT

A control device for an internal combustion engine includes an electronic control unit configured to perform dither control processing for controlling the fuel injection valve based on a requested injection amount such that a part of cylinders among a plurality of cylinders becomes a lean combustion cylinder and cylinders different from the part of cylinders among the cylinders become a rich combustion cylinder, and restriction processing for, in a case where the requested injection amount is equal to or greater than a first injection amount, making no restriction on the dither control processing, and in a case where the requested injection amount is within a second injection amount range of an injection amount smaller than the first injection amount, restricting the dither control processing to a side where a leaning degree of an air-fuel ratio of a cylinder having a leanest air-fuel ratio among the cylinders decreases.

5 Claims, 7 Drawing Sheets

(51) Int. Cl.
*F02D 41/38* (2006.01)
*F01N 3/10* (2006.01)

(52) U.S. Cl.
CPC ..... *F02D 41/38* (2013.01); *F01N 3/10* (2013.01); *F02D 41/1475* (2013.01); *F02D 2041/389* (2013.01); *F02D 2200/0614* (2013.01)

(58) Field of Classification Search
CPC ..... F02D 41/38; F02D 2041/389; F01N 3/10; F01N 3/20; F01N 3/2066
USPC ..... 123/406.11, 406.14–406.17, 406.27, 123/406.47, 472–481; 701/102–105, 107, 701/109, 111, 114; 60/274, 275, 285
See application file for complete search history.

(56) References Cited

U.S. PATENT DOCUMENTS 7,558,667 B2 * 7/2009 Kida ..... F02D 41/1443 123/198 F
8,340,887 B2 * 12/2012 Yamaguchi ..... F02D 35/023 123/299
2004/0250534 A1 * 12/2004 Tanaka ..... F02D 41/0255 60/284
2007/0119415 A1 * 5/2007 Lewis ..... F01N 11/007 123/295
2007/0131203 A1 * 6/2007 Ohga ..... F02D 41/1467 123/478
2007/0175437 A1 * 8/2007 Yamaguchi ..... F02D 35/028 123/294
2008/0087254 A1 * 4/2008 Tanaka ..... F02D 41/20 123/472
2008/0210207 A1 * 9/2008 Boyarski ..... F02M 25/0228 123/575
2011/0017173 A1 * 1/2011 Portin ..... F02D 35/023 123/435
2011/0040475 A1 * 2/2011 Taibi ..... F02D 35/023 701/105
2011/0202255 A1 8/2011 Hauser
2014/0250869 A1 * 9/2014 Kawabe ..... F02M 69/046 60/285
2015/0300245 A1 10/2015 Korenaga

FOREIGN PATENT DOCUMENTS

JP 2001-107790 A 4/2001
JP 2002-327647 A 11/2002
JP 2004-218541 8/2004

* cited by examiner

CONTROL DEVICE FOR INTERNAL COMBUSTION ENGINE

INCORPORATION BY REFERENCE

The disclosure of Japanese Patent Application No. 2017-141733 filed on Jul. 21, 2017 including the specification, drawings and abstract is incorporated herein by reference in its entirety.

BACKGROUND

1. Technical Field

The present disclosure relates to a control device for an internal combustion engine including a catalyst configured to process exhaust gas discharged from a plurality of cylinders and fuel injection valves respectively provided in the cylinders.

2. Description of Related Art

For example, Japanese Unexamined Patent Application Publication No. 2004-218541 (JP 2004-218541 A) describes a control device that, in a case where there is a temperature increase request for a catalyst device (catalyst), executes dither control for making an air-fuel ratio in a part of cylinders richer than a stoichiometric air-fuel ratio, making an air-fuel ratio in the remaining cylinders leaner than the stoichiometric air-fuel ratio, and controlling an air-fuel ratio (exhaust gas air-fuel ratio) of exhaust gas flowing into the catalyst to a target air-fuel ratio.

SUMMARY

On the other hand, in a case where the dither control is executed, an injection amount of the fuel injection valve configured to allow fuel to be supplied to a lean combustion cylinder becomes smaller than an injection amount needed in controlling the exhaust gas air-fuel ratio to the target air-fuel ratio while the injection amount of the fuel injection valve configured to allow fuel to be supplied to each cylinder is kept the same. For this reason, an injection amount of the fuel injection valve configured to allow fuel to be supplied to the lean combustion cylinder becomes smaller than an injection amount where the control accuracy of the fuel injection amount of the fuel injection valve becomes a lower limit value of an allowable range, and as a result, an actual injection amount of the fuel injection valve configured to allow fuel to be supplied to the lean combustion cylinder may become greater than an intended injection amount.

Hereinafter, an aspect of the present disclosure and functional effects thereof will be described. [1] An aspect of the present disclosure relates to a control device for an internal combustion engine. The internal combustion engine includes a plurality of cylinders, a catalyst configured to process exhaust gas discharged from the cylinders, and fuel injection valves respectively provided in the cylinders. The control device includes an electronic control unit configured to perform calculation processing for calculating a requested injection amount according to an operation point of the internal combustion engine, dither control processing for controlling the fuel injection valve based on the requested injection amount such that a part of cylinders among the cylinders becomes a lean combustion cylinder having an air-fuel ratio leaner than a stoichiometric air-fuel ratio, and cylinders different from the part of cylinders among the cylinders become a rich combustion cylinder having an air-fuel ratio richer than the stoichiometric air-fuel ratio, and restriction processing for, in a case where the requested injection amount is equal to or greater than a first injection amount, making no restriction on the dither control processing, and in a case where the requested injection amount is within a second injection amount range of an injection amount smaller than the first injection amount, restricting the dither control processing to a side where a leaning degree of an air-fuel ratio of a cylinder having a leanest air-fuel ratio among the cylinders decreases.

In the aspect of the present disclosure, the dither control processing is restricted through the restriction processing under a condition of the second injection amount smaller than the first injection amount. Here, in a case where the second injection amount is set to an injection amount smaller than a requested injection amount when an injection amount of the fuel injection valve configured to allow fuel to be supplied to the lean combustion cylinder becomes a lower limit value of an allowable range, it is possible to suppress falling of the injection amount of the fuel injection valve configured to allow fuel to be supplied to each of the cylinders below the lower limit value through the restriction processing.

[2] In the control device according to the aspect of the present disclosure, the electronic control unit may be configured to perform, as the restriction processing, prohibition processing for prohibiting the dither control processing. According to the aspect of the present disclosure, it is possible to suppress degradation of controllability of the fuel injection amount with simple control compared to a case of performing processing for making a restriction such that the difference between the air-fuel ratio in the rich combustion cylinder and the air-fuel ratio in the lean combustion cylinder decreases.

[3] In the control device according to the aspect of the present disclosure, the electronic control unit may be configured to perform requested injection amount calculation processing for calculating an injection amount requested for controlling an exhaust gas air-fuel ratio of each of the cylinders to a target air-fuel ratio as the requested injection amount. The dither control processing may include request value setting processing for setting a request value that determines a reduction correction amount with respect to the requested injection amount of a fuel injection amount for the lean combustion cylinder and an increase correction amount with respect to the requested injection amount of a fuel injection amount for the rich combustion cylinder, processing for making the fuel injection valve configured to allow fuel to be supplied to the lean combustion cylinder inject fuel with an injection amount obtained by reducing and correcting the requested injection amount based on the request value, making the fuel injection valve configured to allow fuel to be supplied to the rich combustion cylinder inject fuel with an injection amount obtained by increasing and correcting the requested injection amount based on the request value, and controlling an average value of an exhaust gas air-fuel ratio of the rich combustion cylinder and an exhaust gas air-fuel ratio of the lean combustion cylinder for a predetermined period to the target air-fuel ratio, and processing for providing, within the predetermined period, a period during which a part of cylinders among the cylinders becomes a lean combustion cylinder and cylinders different from the part of cylinders among the cylinders become a rich combustion cylinder. The restriction processing may include determination processing for determining whether or not an injection amount obtained by reducing and correcting the requested injection amount based on the request value is equal to or greater than a third injection amount smaller than the second injection amount range. The second injection amount range may be a range of the requested injection amount where determination is made in the determination processing that the injection amount obtained by reducing and correcting the requested injection amount is less than the third injection amount.

In the aspect of the present disclosure, in a case where the amount obtained by reducing and correcting the requested injection amount based on the request value is equal to or greater than the third injection amount, fuel can be supplied to the lean combustion cylinder with the amount obtained by reducing and correcting the requested injection amount based on the request value. For this reason, in a case where phenomena occur in which the amount obtained by reducing and correcting the requested injection amount based on the request value becomes equal to or greater than the third injection amount and becomes less than the third injection amount even though the operation point is the same, it is possible to meet a temperature increase request of the catalyst to the utmost compared to a case where the dither control is prohibited solely from the operation point without performing the determination processing, for example.

[4] In the control device according to the aspect of the present disclosure, the electronic control unit may be configured to, as the restriction processing, in a case where the requested injection amount is within the second injection amount range, restrict an injection amount of the fuel injection valve configured to allow fuel to be supplied to the lean combustion cylinder to a value equal to or greater than a third injection amount smaller than the second injection amount range.

In the aspect of the present disclosure, the injection amount of the fuel injection valve configured to allow fuel to be supplied to the lean combustion cylinder is set to be equal to or greater than the third injection amount through the restriction processing, and the third injection amount is set to be equal to or greater than an injection amount where the control accuracy of the fuel injection amount becomes a lower limit value of an allowable range, whereby it is possible to suppress degradation of controllability of the fuel injection amount. It is possible to perform the dither control to the utmost compared to a case where the dither control is prohibited in a case of the second injection amount range, and consequently, to meet the temperature increase request of the catalyst to the utmost.

[5] In the control device according to the aspect of the present disclosure, the electronic control unit may be configured to perform requested injection amount calculation processing for calculating an injection amount requested for controlling an exhaust gas air-fuel ratio of each of the cylinders to a target air-fuel ratio as the requested injection amount. The dither control processing may include request value setting processing for setting a request value that determines a reduction correction amount with respect to the requested injection amount of a fuel injection amount for the lean combustion cylinder and an increase correction amount with respect to the requested injection amount of a fuel injection amount for the rich combustion cylinder, processing for making the fuel injection valve configured to allow fuel to be supplied to the lean combustion cylinder inject fuel with an injection amount obtained by reducing and correcting the requested injection amount based on the request value, making the fuel injection valve configured to allow fuel to be supplied to the rich combustion cylinder inject fuel with an injection amount obtained by increasing and correcting the requested injection amount based on the request value, and controlling an average value of an exhaust gas air-fuel ratio of the rich combustion cylinder and an exhaust gas air-fuel ratio of the lean combustion cylinder for a predetermined period to the target air-fuel ratio, and processing for providing, within the predetermined period, a period during which a part of cylinders among the cylinders becomes a lean combustion cylinder and cylinders different from the part of cylinders among the cylinders become a rich combustion cylinder. The restriction processing may include guard processing for, in a case where an injection amount obtained by reducing and correcting the requested injection amount based on the request value becomes less than a third injection amount smaller than the second injection amount range, reducing a leaning degree of an exhaust gas air-fuel ratio of the lean combustion cylinder and an enriching degree of an exhaust gas air-fuel ratio of the rich combustion cylinder such that an injection amount of the fuel injection valve configured to allow fuel to be supplied to the lean combustion cylinder becomes equal to or greater than the third injection amount. The second injection amount range may be a range of the requested injection amount where an injection amount obtained by reducing and correcting the requested injection amount based on the request value becomes less than the third injection amount.

In the aspect of the present disclosure, the guard processing is performed, whereby, in a case where the injection amount obtained by reducing and correcting the requested injection amount based on the request value is equal to or greater than the third injection amount, fuel can be supplied to the lean combustion cylinder with the amount obtained by reducing and correcting the requested injection amount based on the request value. For this reason, in a case where phenomena occur in which the amount obtained by reducing and correcting the requested injection amount based on the request value becomes equal to or greater than the third injection amount and becomes less than the third injection amount even though the operation point is the same, it is possible to adjust the request value to a large value compared to a case where the request value is adjusted such that the injection amount of the lean combustion cylinder becomes equal to or greater than the third injection amount, for example, and thus, it is possible to increase temperature increase performance.

[6] In the control device according to the aspect of the present disclosure, the electronic control unit may be configured to, in a case where pressure of fuel injected by the fuel injection valve is low, set the second injection amount range to an injection amount range where a fuel injection amount is smaller than in a case where pressure of fuel injected is high.

The minimum injection amount where the fuel injection valve can maintain the control accuracy of the injection amount within the allowable range typically tends to depend on an injection time. That is, the minimum injection amount tends to be determined according to a lower limit value of the injection time. A fuel amount injected in a case where the injection time is the lower limit value becomes smaller in a case where pressure of fuel is low than in a case where pressure of fuel is high. For this reason, in a case where pressure of fuel is low, the minimum injection amount becomes smaller than in a case where pressure of fuel is high. For this reason, in the aspect of the present disclosure, the second injection amount range is set to the injection amount range where, in a case where pressure of fuel is low, the fuel injection amount becomes smaller than in a case where pressure of fuel is high.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

First Embodiment

Figure 1:
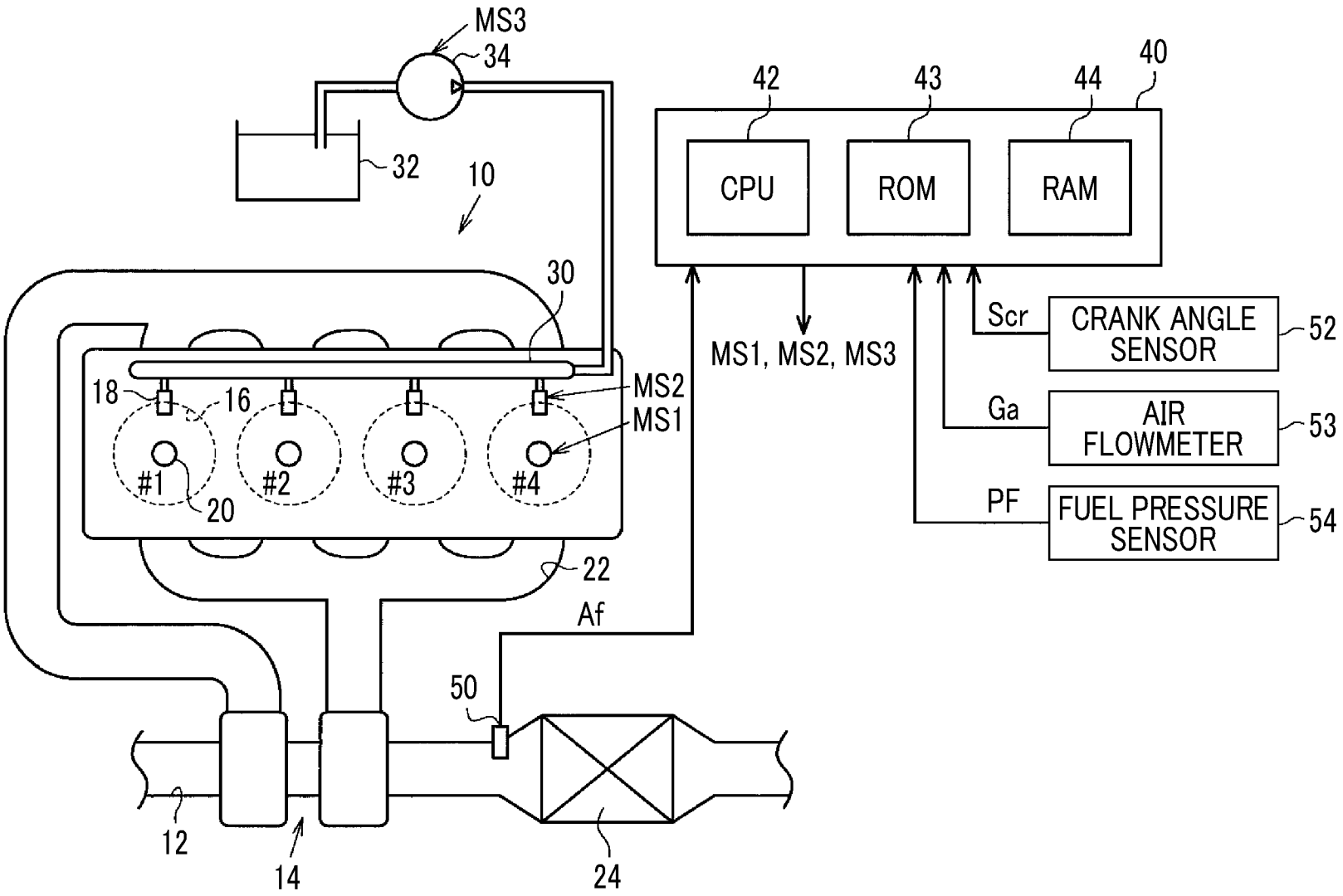
FIG. 1 is a diagram showing a control device and an internal combustion engine according to a first embodiment.

Hereinafter, a first embodiment of a control device for an internal combustion engine will be described referring to the drawings.

In an internal combustion engine 10 shown in FIG. 1, air sucked from an intake passage 12 flows into a combustion chamber 16 of each cylinder through a turbocharger 14. In the combustion chamber 16, a fuel injection valve 18 that injects fuel and an ignition device 20 that causes spark discharge are projected. In the first embodiment, it is assumed that an electromagnetic valve is provided as the fuel injection valve 18. In the combustion chamber 16, an air-fuel mixture of air and fuel is supplied for combustion, and the air-fuel mixture supplied for combustion is discharged as exhaust gas to an exhaust passage 22. In the exhaust passage 22 downstream of the turbocharger 14, a three-way catalyst 24 having oxygen storage ability is provided. The fuel injection valve 18 injects fuel in a delivery pipe 30. Fuel stored in a fuel tank 32 is sucked and pressurized by a fuel pump 34 and is supplied to a delivery pipe 30.

A control device 40 adapts the internal combustion engine 10 as a control target, and operates an operating unit of the internal combustion engine 10, such as the fuel injection valve 18, the ignition device 20, or the fuel pump 34, in order to control a control amount (torque, exhaust gas component, or the like) of the internal combustion engine 10.

At this time, the control device 40 refers to an air-fuel ratio Af detected by an air-fuel ratio sensor 50 upstream of the three-way catalyst 24, an output signal Scr of a crank angle sensor 52, an intake air amount Ga detected by an air flowmeter 54, and pressure (hereinafter, referred to as fuel pressure PF) of fuel in the delivery pipe 30 detected by a fuel pressure sensor 56. The control device 40 includes a central processing unit (CPU) 42, a reach only memory (ROM) 44, and a random access memory (RAM) 46, and executes control of the control amount by the CPU 42 executing a program stored in the ROM 44.

Figure 2:
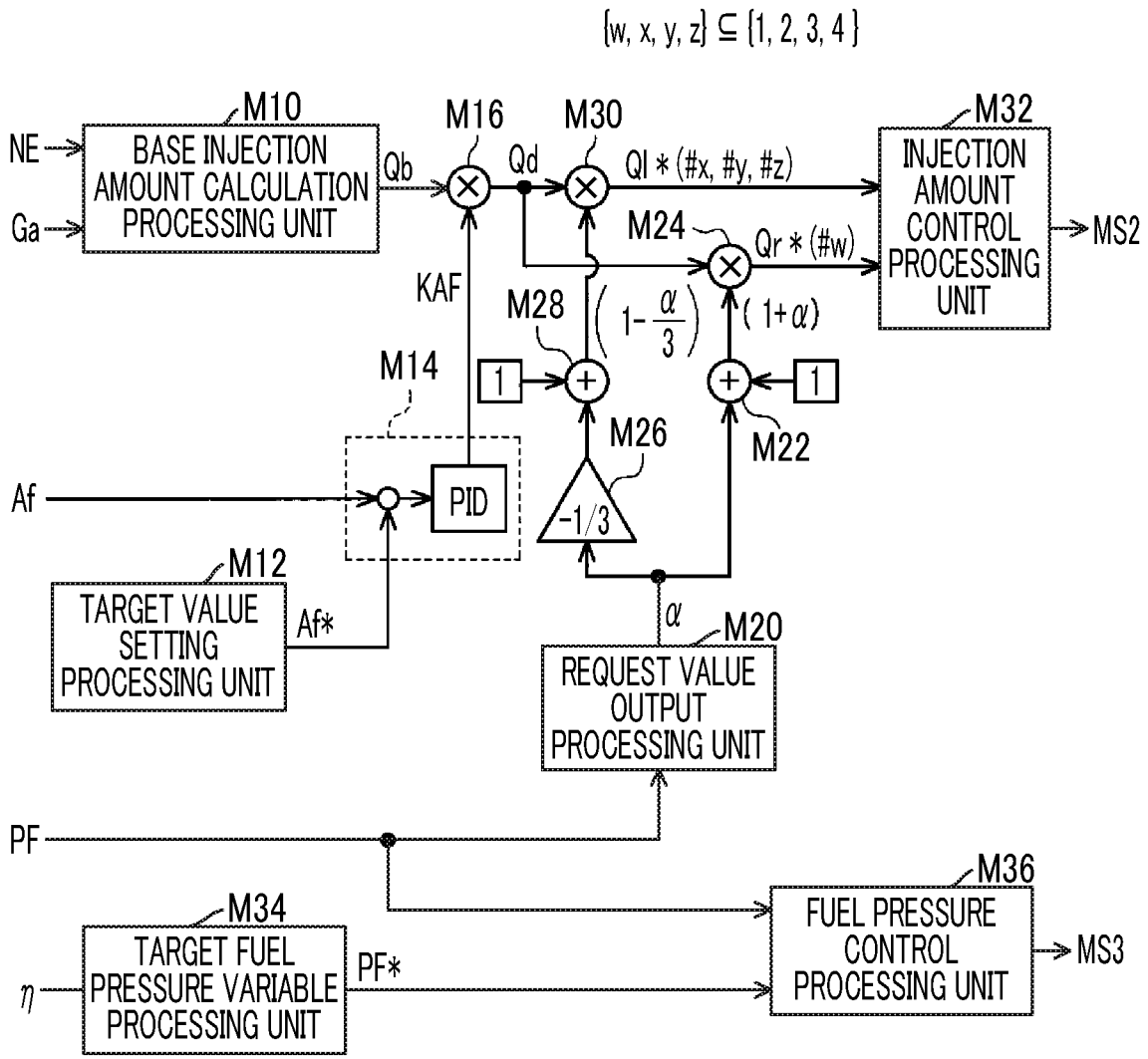
FIG. 2 is a block diagram showing a part of processing that the control device according to the first embodiment executes.

FIG. 2 shows a part of processing that is realized by the CPU 42 executing the program stored in the ROM 44. A base injection amount calculation processing unit M10 calculates, based on a rotation speed NE calculated according to the output signal Scr of the crank angle sensor 52 and the intake air amount Ga, a base injection amount Qb as an open loop operation amount that is an operation amount for controlling an air-fuel ratio of the air-fuel mixture in the combustion chamber 16 to a target air-fuel ratio in an open loop.

A target value setting processing unit M12 sets a target value Af* of a feedback control amount for controlling the air-fuel ratio of the air-fuel mixture in the combustion chamber 16 to the target air-fuel ratio. A feedback control processing unit M14 calculates a feedback operation amount KAF that is an operation amount for executing feedback control of the air-fuel ratio Af as the feedback control amount to the target value Af*. In the first embodiment, the sum of output values of a proportional element, an integral element, and a differential element with a value obtained by subtracting the air-fuel ratio Af from the target value Af* as input is set as the feedback operation amount KAF.

A feedback correction processing unit M16 calculates and outputs a requested injection amount Qd obtained by multiplying the base injection amount Qb by the feedback operation amount KAF. A request value output processing unit M20 calculates an injection amount correction request value c of dither control for, while setting an average value of the air-fuel ratios (exhaust gas air-fuel ratios) of exhaust gas from the cylinders #1 to #4 of the internal combustion engine 10 as a target air-fuel ratio, making the air-fuel ratio of the air-fuel mixture to be a combustion target among the cylinders. Here, in the dither control according to the first embodiment, one cylinder among the first cylinder #1 to the fourth cylinder #4 becomes a rich combustion cylinder having the air-fuel ratio of the air-fuel mixture richer than a stoichiometric air-fuel ratio, and the remaining three cylinders become a lean combustion cylinder having the air-fuel ratio of the air-fuel mixture leaner than the stoichiometric air-fuel ratio. An injection amount in the rich combustion cylinder is set to be "$1+\alpha$" times the requested injection amount Qd, and an injection amount in the lean combustion cylinder is set to be "$1-(\alpha/3)$" times the requested injection amount Qd.

An exhaust gas air-fuel ratio of target exhaust gas is defined using a virtual air-fuel mixture. That is, the virtual air-fuel mixture is defined as an air-fuel mixture that is made of solely fresh air and fuel and has a non-combustible fuel concentration (for example, HC) of exhaust gas produced in a case where combustion is made, incomplete combustion component concentration (for example, CO), and an oxygen concentration the same as a non-combustible fuel concentration, an incomplete combustion component concentration, and an oxygen concentration of target exhaust gas, and the exhaust gas air-fuel ratio is defined as the air-fuel ratio of the virtual air-fuel mixture. However, combustion of the virtual air-fuel mixture is not limited to combustion where at least one of the non-combustible fuel concentration and the incomplete combustion component concentration and oxygen concentration becomes zero or a value regarded as zero, and includes combustion where both of the non-combustible fuel concentration and the incomplete combustion component concentration and oxygen concentration are greater than zero. The average value of the exhaust gas air-fuel ratios of the cylinders is an exhaust gas air-fuel ratio in a case where the whole exhaust gas discharged from the cylinders is defined as target exhaust gas. According to the settings of the injection amounts of the lean combustion cylinder and the rich combustion cylinder, the average value of fuel-air ratios of the air-fuel mixture to be a combustion target in the cylinders is set as a target fuel-air ratio, whereby it is possible to set the average value of the exhaust gas air-fuel ratios as the target air-fuel ratio. The fuel-air ratio is a reciprocal of the air-fuel ratio.

A correction coefficient calculation processing unit M22 calculates a correction coefficient of the requested injection amount Qd regarding the rich combustion cylinder by adding the injection amount correction request value $\alpha$ to "1". A dither correction processing unit M24 calculates an injection amount command value Qr* of the rich combustion cylinder by multiplying the requested injection amount Qd by a correction coefficient "$1+\alpha$".

A multiplication processing unit M26 multiplies the injection amount correction request value $\alpha$ by "$-1/3$", and the correction coefficient calculation processing unit M28 calculates a correction coefficient of the requested injection amount Qd regarding the lean combustion cylinder by adding an output value of the multiplication processing unit M26 to "1". A dither correction processing unit M30 calculates an injection amount command value Ql* of the lean combustion cylinder by multiplying the requested injection amount Qd by a correction coefficient "$1-(\alpha/3)$".

An injection amount control processing unit M32 generates an operation signal MS2 of the fuel injection valve 18 of the rich combustion cylinder based on the injection amount command value Qr*, outputs the operation signal MS2 to the fuel injection valve 18, and supplies power to the electromagnetic valve of the fuel injection valve 18 such that a fuel amount injected from the fuel injection valve 18 becomes an amount according to the injection amount command value Qr*. The injection amount control processing unit M32 generates the operation signal MS2 of the fuel injection valve 18 of the lean combustion cylinder based on the injection amount command value Ql*, outputs the operation signal MS2 to the fuel injection valve 18, and supplies power to the electromagnetic valve of the fuel injection valve 18 such that a fuel amount injected from the fuel injection valve 18 becomes an amount according to the injection amount command value Ql*. It is preferable that a cylinder to be a rich combustion cylinder among the cylinders #1 to #4 is changed in a cycle longer than one combustion cycle. In a case where the injection amount correction request value c is zero, the injection amount command value of each of the cylinders #1 to #4 becomes the requested injection amount Qd; however, FIG. 2 shows the injection amount command values Ql*, Qr* during the dither control for convenience. In a case where the injection amount correction request value c is zero, the operation signal MS2 is calculated from the requested injection amount Qd.

A target fuel pressure variable processing unit M34 variably sets a target fuel pressure PF* as a target value of the fuel pressure PF based on a filling efficiency $\eta$. The filling efficiency $\eta$ is a parameter indicating a load, and is calculated based on the rotation speed NE and the intake air amount Ga by the CPU 42. In detail, the target fuel pressure variable processing unit M34 sets the target fuel pressure PF* to a value greater in a case where the filling efficiency $\eta$ is high than in a case where the filling efficiency $\eta$ is low. A fuel pressure control processing unit M36 outputs an operation signal MS3 to the fuel pump 34 to operate the fuel pump 34 in order to execute feedback control of the fuel pressure PF to the target fuel pressure PF*.

Figure 3:
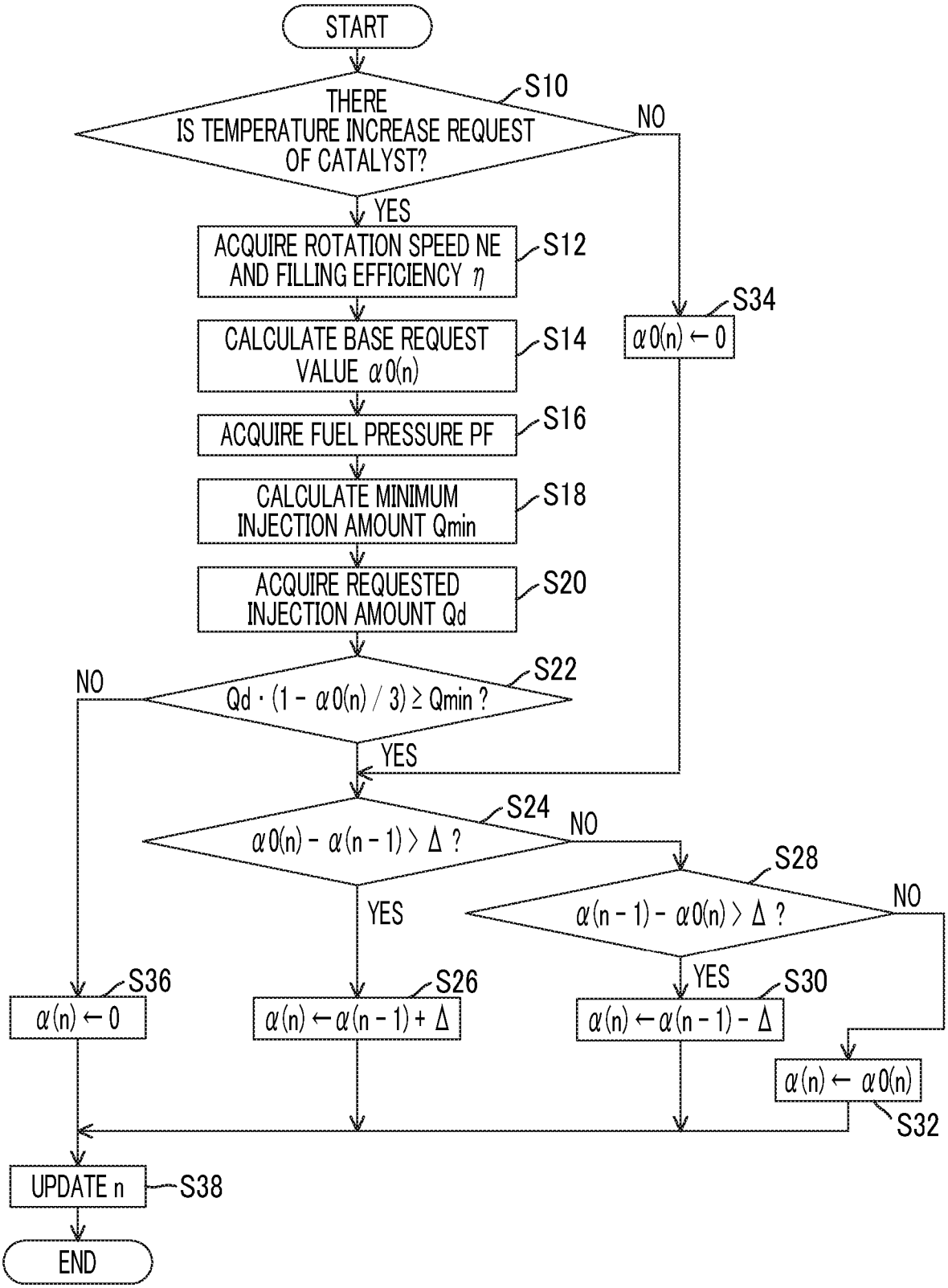
FIG. 3 is a flowchart showing a procedure of processing of a request value output processing unit according to the first embodiment.

FIG. 3 shows a procedure of processing of the request value output processing unit M20. The processing shown in FIG. 3 is realized by the CPU 42 repeatedly executing the program stored in the ROM 44, for example, at an angle interval (180° CA) between compression top dead centers of cylinders where the appearance timings of the compression top dead centers are adjacent in a time series among the cylinders #1 to #4. Hereinafter, a step number is expressed by a number with "S" attached to the head.

In a sequence of processing shown in FIG. 3, the CPU 42 determines whether or not a temperature increase request of the three-way catalyst 24 using the dither control is issued (S10). In the first embodiment, the temperature increase request of the catalyst is issued in a case where a warm-up request of the three-way catalyst 24 is issued and in a case where an execution condition of sulfur poisoning recovery processing of the three-way catalyst 24 is established. The warm-up request of the three-way catalyst 24 is issued in a case where a temperature (coolant temperature THW) of a coolant of the internal combustion engine 10 is equal to or lower than a predetermined temperature and the integrated air amount is equal to or less than a predetermined value (>specified value) after determination is made that a tip temperature of the three-way catalyst 24 becomes an activation temperature when an integrated air amount after the start becomes equal to or greater than a specified value. The execution condition of the sulfur poisoning recovery processing may be established in a case where a sulfur poisoning amount of the three-way catalyst 24 becomes equal to or greater than a prescribed value. The sulfur poisoning amount may be calculated, for example, by calculating an increase amount of a poisoning amount greater when the rotation speed NE is higher and when the filling efficiency $\eta$ is higher, and integrating the increase amount.

The CPU 42 acquires the rotation speed NE and the filling efficiency $\eta$ (S12). The CPU 42 calculates a base request value $\alpha 0$ as a base value of the injection amount correction request value $\alpha$ based on the rotation speed NE and the filling efficiency $\eta$ (S14). The base request value $\alpha 0$ becomes maximum in a medium load region. This is because, since the following: since combustion is unstable in a low load region compared to the medium load region, the base request value $\alpha 0$ hardly increases in the low load region compared to the medium load region, and the exhaust gas temperature is high in a high load region even though the dither control is not executed. The base request value $\alpha 0$ becomes a value greater in a case where the rotation speed NE is high than in a case where the rotation speed NE is low. This is because, since combustion is stable in a case where the rotation speed NE is high compared to a case where the rotation speed NE is high, the base request value $\alpha 0$ is easily set to a large value. Specifically, map data where the relationship of the rotation speed NE and the filling efficiency $\eta$ as an input variable and the base request value $\alpha 0$ as an output variable is determined may be stored in the ROM 44, and the CPU 42 may perform map calculation of the base request value $\alpha 0$ using the map data. A map is set data of a discrete value of the input variable and a value of the output variable corresponding to each value of the input variable. The map calculation may be, for example, processing for, in a case where the value of the input variable coincides with any one of the values of the input variable of the map data, obtaining the value of the corresponding output variable as a calculation result, and in a case where the value of the input variable does not coincide with any one of the values of the input variable of the map data, obtaining a value obtained by interpolation of the values of a plurality of output variables included in the set data as a calculation result.

Incidentally, in FIG. 3, "α0(n)" is described using a variable n in the processing of S14. The variable n is to designate specific data among time-series data, such as the base request value α0. Hereinafter, data calculated in a present control cycle of a control cycle of a sequence of processing of FIG. 3 is described as "n", and data calculated in a previous control cycle is described as "n−1".

Figure 4:
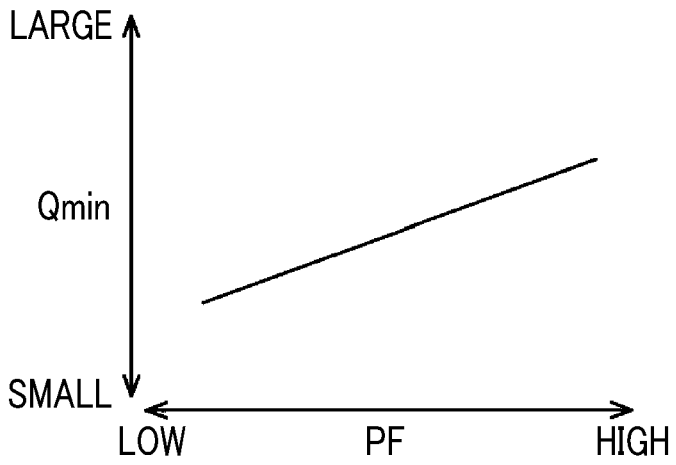
FIG. 4 is a diagram showing a setting method of a minimum injection amount according to the first embodiment.

The CPU 42 acquires the fuel pressure PF (S16). The CPU 42 calculates a minimum injection amount Qmin that is a minimum value of the injection amount of the fuel injection valve 18 (S18). The minimum injection amount Qmin is set based on a minimum value of an injection time for which controllability of the injection amount can be made within an allowable range in the fuel amount injectable from the fuel injection valve 18. Since the injection amount changes according to the fuel pressure PF even though the injection time is the same, the CPU 42 calculates the minimum injection amount Qmin according to the fuel pressure PR FIG. 4 show the relationship of the fuel pressure PF and the minimum injection amount Qmin. As shown in FIG. 4, in a case where the fuel pressure PF is high, the minimum injection amount Qmin becomes a large value compared to a case where the fuel pressure PF is low. In detail, map data having the fuel pressure PF as an input variable and the minimum injection amount Qmin as an output variable is stored in the ROM 44, and the CPU 42 performs map calculation of the minimum injection amount Qmin.

Returning to FIG. 3, the CPU 42 acquires the requested injection amount Qd (S20). In this case, the requested injection amount Qd is a latest value calculated by the feedback correction processing unit M16. The CPU 42 predicts the injection amount command value Ql* of the present lean combustion cylinder based on the requested injection amount Qd and the base request value α0(n), and determines whether or not the predicted value "Qd·{1−α0(n)/3}" is equal to or greater than the minimum injection amount Qmin (S22). In a case where determination is made that the predicted value is equal to or greater than the minimum injection amount Qmin (S22: YES), the CPU 42 determines whether or not a value obtained by subtracting a previous injection amount correction request value α(n−1) from the base request value α0(n) calculated at this time in the processing of S14 is greater than a threshold Δ in order to execute the dither control (S24). In a case where determination is made that the subtracted value is greater than the threshold Δ (S24: YES), a value obtained by adding the threshold Δ to the previous injection amount correction request value α(n−1) is substituted in the present injection amount correction request value α(n) (S26). In contrast, in a case where determination is made that the subtracted value is equal to or less than the threshold Δ(S24: NO), the CPU 42 determines whether or not a value obtained by subtracting the base request value α0(n) calculated at this time in the processing of S14 from the previous injection amount correction request value α(n−1) is greater than the threshold Δ (S28). In a case where determination is made that the subtracted value is greater than the threshold Δ (S28: YES), the CPU 42 substitutes a value obtained by subtracting the threshold Δ from the previous injection amount correction request value α(n−1) in the present injection amount correction request value α(n) (S30). In a case where determination is made that the subtracted value is equal to or less than the threshold Δ (S28: NO), the CPU 42 substitutes the present base request value α0(n) in the present injection amount correction request value α(n) (S32).

In a case where determination is made that the temperature increase request of the catalyst is not issued (S10: NO), the CPU 42 sets the present base request value α0(n) to zero (S34), and progresses processing of S24. In contrast, in a case where determination is made that the predicted value of the injection amount command value Ql* of the lean combustion cylinder is less than the minimum injection amount Qmin (S22: NO), the CPU 42 substitutes zero in the injection amount correction request value α(n) (S36). In this way, the dither control is prohibited.

In a case where the processing of the S26, S30, S32, S36 is completed, the CPU 42 updates the variable n (S38), and ends a sequence of processing shown in FIG. 3 once. Here, the operation of the first embodiment will be described.

Figure 5:
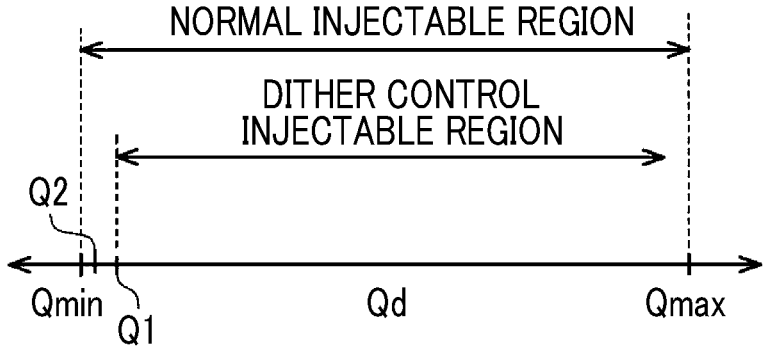
FIG. 5 is a diagram showing an injectable region according to the first embodiment.

In a case where the temperature increase request of the catalyst is issued, the CPU 42 predicts the injection amount command value Ql* of the lean combustion cylinder based on the requested injection amount Qd, and executes the dither control under a condition that the predicted value is equal to or greater than the minimum injection amount Qmin. For this reason, as shown in FIG. 5, the first injection amount Ql that is the minimum value of the requested injection amount Qd in a case where the dither control is executed becomes a large injection amount compared to the minimum injection amount Qmin when fuel is injected from the fuel injection valve 18 in a case where the dither control is not executed. That is, in a case where a second injection amount Q2 between the first injection amount Ql and the minimum injection amount Qmin is the requested injection amount Qd, the dither control is not executed even though the temperature increase request of the catalyst is issued, and fuel injection control is executed while substituting the requested injection amount Qd in the injection amount command values of all of the cylinders #1 to #4. In contrast, in a case where the requested injection amount Qd is the first injection amount Ql, the dither control is executed under a condition that the temperature increase request of the catalyst is issued.

The first injection amount Ql that is the minimum value of the requested injection amount Qd in a case where the dither control is executed becomes a value smaller in a case where the fuel pressure PF is low than in a case where the fuel pressure PF is high. In FIG. 5, although the requested injection amount Qd where the dither control is executed is set as one continuous region equal to or greater than the first injection amount Ql, the present disclosure is not limited thereto. That is, determination is made to be negative in S22 when the requested injection amount Qd of the cylinder where the dither control is executed with the first injection amount Ql is greater than the first injection amount Ql according to a way of variably setting the base request value α0 according to the rotation speed NE and the filling efficiency η or the value of the feedback operation amount KAF, and there may be a region where the dither control is prohibited. In this case, in a region where the injection amount is larger, the dither control is permitted.

Figure 6:
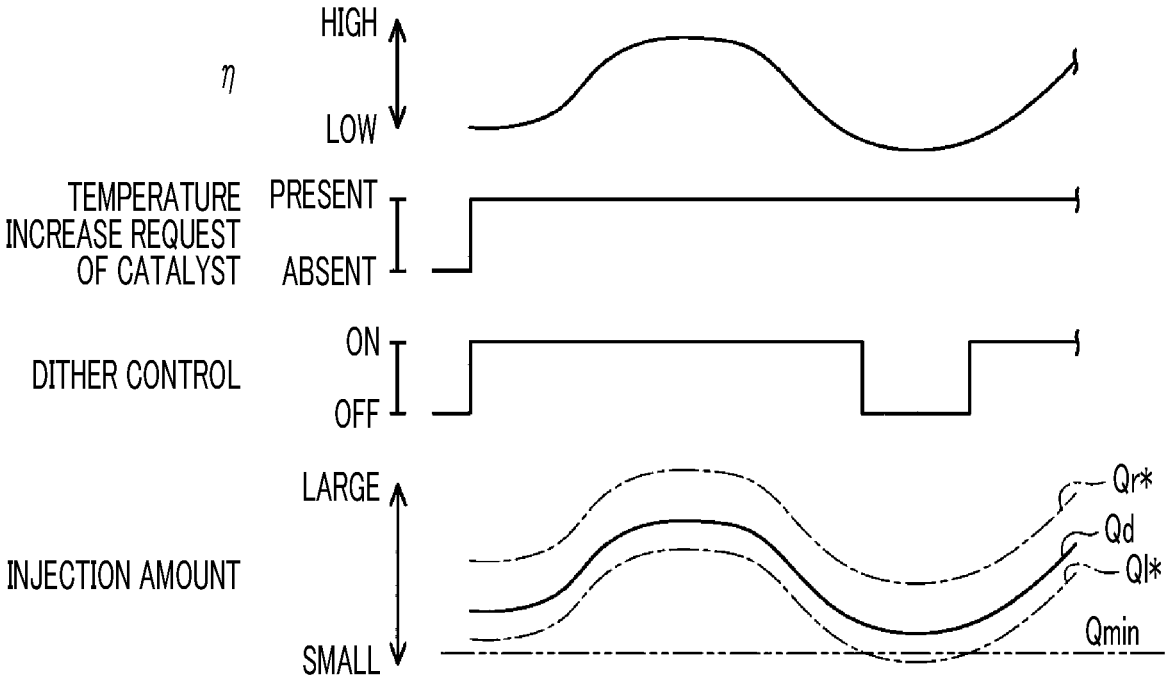
FIG. 6 is a time chart showing a transition example of execution and prohibition of dither control according to the first embodiment.

FIG. 6 shows a transition example of each of the filling efficiency η, the presence or absence of the temperature increase request of the catalyst, the presence or absence of the execution of the dither control, and the injection amount according to the first embodiment. As shown in FIG. 6, the filling efficiency η decreases and the requested injection amount Qd decreases, whereby, in a case where the injection amount command value Ql* of the lean combustion cylinder may fall below the minimum injection amount Qmin, the dither control is prohibited. In a case where the dither control is prohibited, the injection amount command value Ql* of the lean combustion cylinder and the injection amount command value Qr* of the rich combustion cylinder are not defined; however, in FIG. 6, transition of an injection amount command value in a case where the dither control is not prohibited is indicated by a one-dot-chain line. With this, it is possible to suppress the occurrence of a situation in which an actual injection amount of the lean combustion cylinder becomes greater than "Qd·{1−(α/3)}". For this reason, it is possible to suppress torque fluctuation or deterioration of an exhaust gas component.

Figure 7:
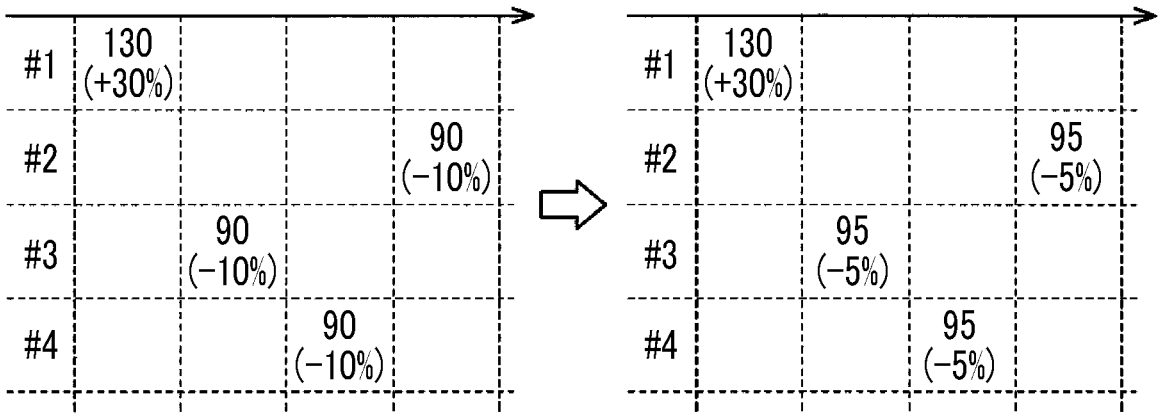
FIG. 7 is a diagram showing effects of the first embodiment.

In contrast, the injection amount of each cylinder through the dither control in a case where the processing of S22, S36 of FIG. 3 is not executed is illustrated in FIG. 7. The left of FIG. 7 illustrates a case where the cylinder #1 is a rich combustion cylinder, the cylinders #2 to #4 are a lean combustion cylinder, the requested injection amount Qd is "100", the minimum injection amount Qmin is "95", and the base request value α0 set based on the rotation speed NE and the filling efficiency η is "0.3". In this case, in setting the average value of the exhaust gas air-fuel ratios of the cylinders #1 to #4 as the target air-fuel ratio, there is a need to set the injection amount of the lean combustion cylinder to "90". However, since the minimum injection amount Qmin is "95", as shown on the right of FIG. 7, the injection amount of the lean combustion cylinder is set to "95", whereby the average value of the exhaust gas air-fuel ratios of the cylinders #1 to #4 becomes richer than the target air-fuel ratio.

According to the first embodiment described above, the following effects are further obtained. (1) In a case where the minimum injection amount Qmin is set to be smaller in a case where the fuel pressure PF is low than in a case where the fuel pressure PF is high. With this, it is possible to appropriately set the minimum injection amount Qmin by reflecting the dependence of the minimum injection amount Qmin of the fuel injection valve 18 on the fuel pressure PF.

(2) The injection amount command value Ql* of the lean combustion cylinder is predicted based on the requested injection amount Qd and the base request value α0 at each time, and the predicted value is compared with the minimum injection amount Qmin With this, compared to a case where the base request value α0 is adjusted with an assumed value of the requested injection amount Qd such that the injection amount command value Ql* of the lean combustion cylinder does not become less than the minimum injection amount Qmin, it is possible to increase a temperature increase effect through the dither control. That is, since the requested injection amount Qd is determined according to the feedback operation amount KAF, even though the rotation speed NE and the filling efficiency η are the same, the requested injection amount Qd fluctuates according to the feedback operation amount KAF. The minimum injection amount Qmin fluctuates according to the fuel pressure PF. For this reason, the base request value α0 is set according to the value of the feedback operation amount KAF or the fuel pressure PF such that the injection amount command value Ql* of the lean combustion cylinder can become less than the minimum injection amount Qmin or can become equal to or greater than the minimum injection amount Qmin, whereby the base request value α0 can be set to a large value compared to a case where the base request value α0 is set such that the injection amount command value Ql* becomes merely equal to or greater than the minimum injection amount Qmin. In a case where the base request value α0 is set to a large value, the temperature increase effect increases compared to a case where the base request value α0 is set to a small value.

Second Embodiment

Hereinafter, a second embodiment will be described referring to the drawings focusing on the difference from the first embodiment.

Figure 8:
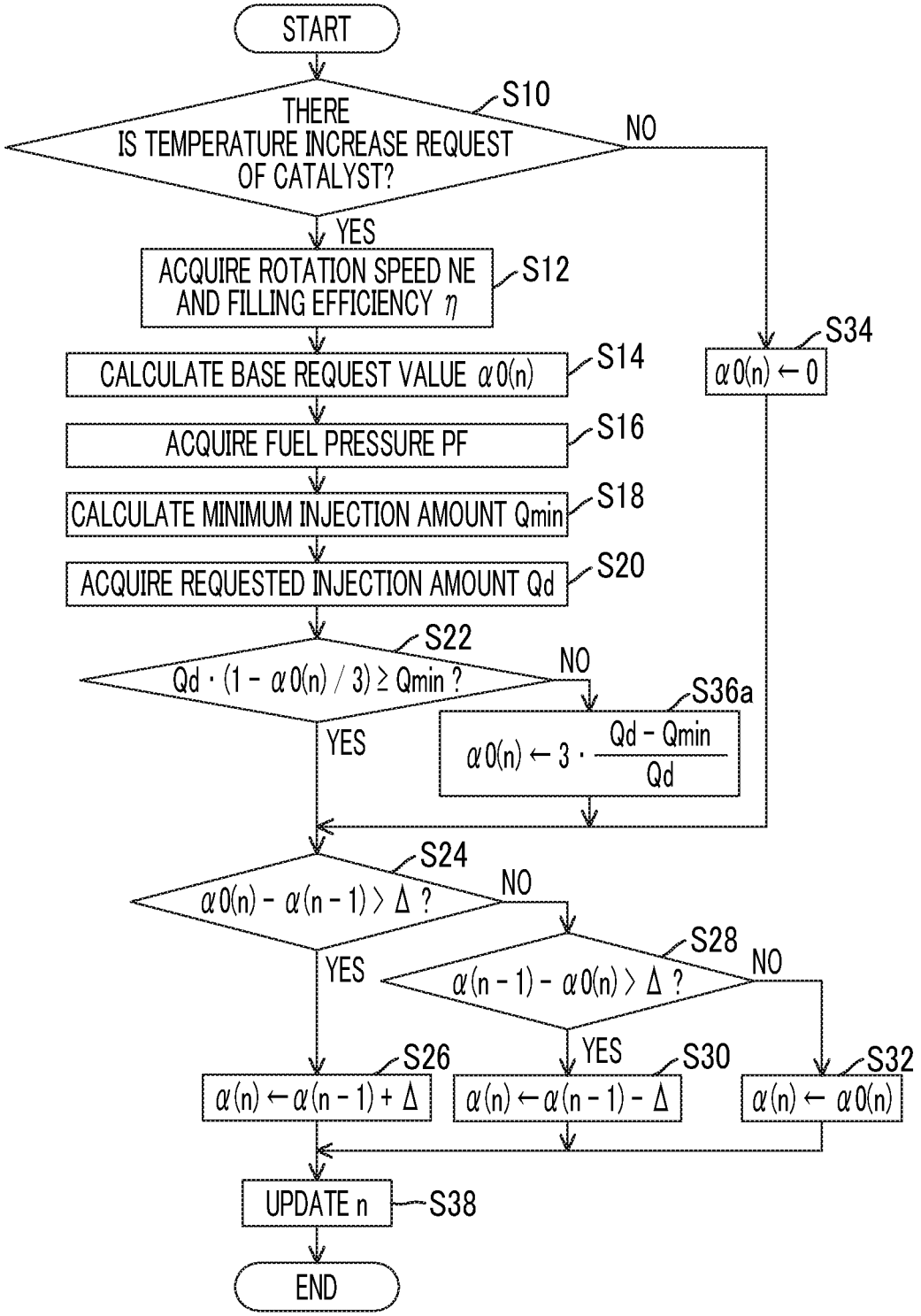
FIG. 8 is a flowchart showing a procedure of processing of a request value output processing unit according to a second embodiment.

FIG. 8 shows a procedure of processing of the request value output processing unit M20 according to the second embodiment. The processing shown in FIG. 8 is realized by the CPU 42 repeatedly executing the program stored in the ROM 44, for example, at an angle interval (180° CA) between compression top dead centers of cylinders where the appearance timings of the compression top dead centers are adjacent in a time series among the cylinders #1 to #4. In FIG. 8, processing corresponding to the processing shown in FIG. 3 is attached with the same step number for convenience, and description thereof will not be repeated.

In a sequence of processing shown in FIG. 8, in a case where determination is made that the predicted value of the injection amount command value Ql* of the lean combustion cylinder is less than the minimum injection amount Qmin (S22: NO), the CPU 42 substitutes a value expressed by Expression (c1) in the base request value α0(n) (S36*a*), and progresses to the processing of S24.

$$3\cdot(Qd-Q\min)/Qd \tag{c1}$$

The processing of S22, S36*a* is guard processing for setting a lower limit value of the injection amount command value Ql* of the lean combustion cylinder as the minimum injection amount Qmin That is, when the requested injection amount Qd is given, in setting the injection amount command value Ql* as the minimum injection amount Qmin, Expression (c2) should be satisfied.

$$Qd\cdot\{1-(\alpha 0/3)\}=Q\min \tag{c2}$$

It is understood that the base request value α0 should be Expression (c1) by solving Expression (c2) as to the base request value α0.

Here, the operation of the second embodiment will be described. In a case where determination is made that the predicted value of the injection amount command value Ql* of the lean combustion cylinder becomes less than the minimum injection amount Qmin, the CPU 42 changes the base request value α0 such that the injection amount command value Ql* of the lean combustion cylinder becomes the minimum injection amount Qmin (S36*a*). The CPU 42 calculates the injection amount command value Qr* of the rich combustion cylinder and the injection amount command value Ql* of the lean combustion cylinder based on the changed base request value α0 such that the average value of the exhaust gas air-fuel ratio of the rich combustion cylinder and the exhaust gas air-fuel ratio of the lean combustion cylinder becomes a target average value, and controls the fuel injection valve 18 based on the above-described values.

Figure 9:
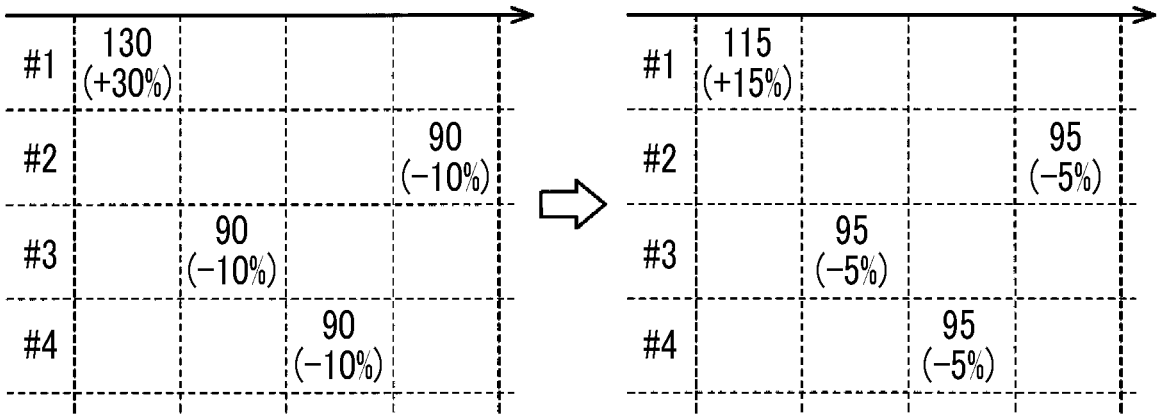
FIG. 9 is a diagram showing effects of the second embodiment.

The left of FIG. 9 illustrates a case where the cylinder #1 is a rich combustion cylinder, the cylinders #2 to #4 are a lean combustion cylinder, the requested injection amount Qd is "100", the minimum injection amount Qmin is "95", and the base request value α0 determined by the rotation speed NE and the filling efficiency η is "0.3". In this case, as described referring to FIG. 7, the injection amount command value Ql* of the lean combustion cylinder becomes less than the minimum injection amount Qmin. In the second embodiment, as shown on the right of FIG. 9, the base request value α0 is changed such that the injection amount command value Ql* of the lean combustion cylinder becomes equal to or greater than the minimum injection amount Qmin.

Correspondence Relationship

The correspondence relationship between the matters in the embodiments and the matters described in SUMMARY is as follows. Hereinafter, the correspondence relationship is shown for each number of the solutions described in SUMMARY. [1] The catalyst corresponds to the three-way catalyst 24, and the calculation processing corresponds to the processing of S20. The dither control processing corresponds to the processing of the correction coefficient calculation processing unit M22, the dither correction processing unit M24, the multiplication processing unit M26, the correction coefficient calculation processing unit M28, the dither correction processing unit M30, and the injection amount control processing unit M32 and the processing of S10, S12, S22 to S34. The restriction processing corresponds to the processing of S22, S36 (S36*a*). [2] The prohibition processing corresponds to the processing of S36. [3] The requested injection amount calculation processing corresponds to the processing of the base injection amount calculation processing unit M10, the target value setting processing unit M12, the feedback control processing unit M14, and the feedback correction processing unit M16. The request value setting processing corresponds to the processing of S14, and the third injection amount corresponds to the minimum injection amount Qmin. [4] This corresponds to the processing of S36*a*. [5] The requested injection amount calculation processing corresponds to the processing of the base injection amount calculation processing unit M10, the target value setting processing unit M12, the feedback control processing unit M14, and the feedback correction processing unit M16. The request value setting processing corresponds to the processing of S14, and the third injection amount corresponds to the minimum injection amount Qmin. The guard processing corresponds to the processing of S22, S36*a*. [6] This corresponds to the description in FIG. 4 that the minimum injection amount Qmin corresponding to the third injection amount is smaller in a case where the fuel pressure PF is low than in a case where the fuel pressure PF is high, and the description in FIG. 5 that the second injection amount Q2 is between the minimum injection amount Qmin and the first injection amount Ql. That is, the above description means that, since at least the base request value α0 through the processing of S14 is the same value, the second injection amount Q2 becomes smaller in a case where the fuel pressure PF is low than in a case where the fuel pressure PF is high.

Other Embodiments

At least one of the matters of the embodiments may be changed as follows.

"Dither Control Processing"

The base request value α0 may be variably set based on the coolant temperature THW in addition to the rotation speed NE and the filling efficiency η. For example, the base request value α0 may be variably set based on solely two parameters of the rotation speed NE and the coolant temperature THW or the filling efficiency η and the coolant temperature THW, or for example, may be variably set based on solely one parameters among the three parameters. For example, instead of using the rotation speed NE and the filling efficiency η as parameters for specifying the operation point of the internal combustion engine 10, for example, an accelerator operation amount as a load may be used instead of the filling efficiency η as a load. The base request value α0 may be variably set based on the intake air amount Ga instead of the rotation speed NE and the load.

A configuration in which the base request value α0 is variably set based on the parameters is not indispensable. For example, the base request value α0 may be set to a fixed value. In the embodiments, although the number of lean combustion cylinders is greater than the number of rich combustion cylinders, the present disclosure is not limited thereto. For example, the number of rich combustion cylinders may be the same as the number of lean combustion cylinders. For example, the present disclosure is not limited to a case where all of the cylinders #1 to #4 become a lean combustion cylinder or a rich combustion cylinder, and for example, the air-fuel ratio of one cylinder may be set as the target air-fuel ratio. A configuration in which the average value of the exhaust gas air-fuel ratios becomes the target air-fuel ratio within one combustion cycle is not indispensable. For example, in a case of the four cylinders as in the embodiments, a configuration may be made in which the average value of the exhaust gas air-fuel ratios may become a target value in five strokes, or the average value of the exhaust gas air-fuel ratios may become a target value in three strokes. However, it is preferable that a period during which there are both of the rich combustion cylinder and the lean combustion cylinder in one combustion cycle occurs once or more in at least two combustion cycles. In other words, when the average value of the exhaust gas air-fuel ratios is set as the target air-fuel ratio in a predetermined period, it is preferable that the predetermined period is set to be equal to or less than two combustion cycles. Here, for example, in a case where there is a rich combustion cylinder solely once for two combustion cycles with the predetermined period as the two combustion cycles, an appearance order of the rich combustion cylinder and the lean combustion cylinder becomes, for example, "R, L, L, L, L, L, L" when the rich combustion cylinder is referred to as R and the lean combustion cylinder is referred to as L. In this case, a period of "R, L, L" is provided in a period of one combustion cycle shorter than the predetermined period, a part of the cylinders #1 to #4 becomes a lean combustion cylinder, and other cylinders become a rich combustion cylinder. Incidentally, in a case where the average value of the exhaust gas air-fuel ratios is not set as the target air-fuel ratio in one combustion cycle, it is preferable that the amount of air sucked by the internal combustion engine in an intake stroke once and partially blown back to the intake passage until an intake valve is closed is negligible.

"Prohibition Processing"

The prohibition processing is not limited to the processing as illustrated in the processing of FIG. 3 for, in a case where determination is made to be negative in the processing of S22, setting the injection amount correction request value α(n) to zero. For example, in a case where determination is made to be negative in the processing of S22, processing for substituting zero in the base request value α0 may be performed. Even in this case, the number of times of determination to be negative at least in the processing of S22 is continuous multiple times, whereby the injection amount correction request value α(n) becomes zero and the dither control is prohibited.

"Determination Processing"

The determination processing for determining whether or not the injection amount obtained by reducing and correcting the requested injection amount Qd based on the request value, such as the base request value α0, is equal to or greater than the third injection amount (minimum injection amount Qmin) is not limited to the processing of S22. For example, processing for determining whether or not "Qd·{1−(α/3)}" is equal to or greater than the minimum injection amount Qmin using an injection amount correction request value α obtained by subjecting the base request value α0 to gradual variation processing through the processing of S24 to S32 instead of the base request value α0.

The determination processing for determining whether or not the injection amount obtained by reducing and correcting the requested injection amount Qd based on the request value, such as the base request value α0, is equal to or greater than the third injection amount (minimum injection amount Qmin) is not limited as being executed in a crank angle cycle, and may be executed in a time cycle.

"Guard Processing"

In the embodiments, although the base request value α0 is changed in order to make the injection amount command value Ql* of the lean combustion cylinder be equal to or greater than the minimum injection amount Qmin, the present disclosure is not limited thereto. For example, in a case where determination is made that the predicted value of the injection amount command value Ql* of the lean combustion cylinder becomes less than the minimum injection amount Qmin when the dither control is already executed, the value of Expression (c1) may be substituted in the injection amount correction request value α.

The guard processing is not limited to that illustrated in the processing of FIG. 8. For example, in a case where the base request value α0(n) calculated in the processing of S36*a* is less than the specified value, the base request value α0(n) may be set to zero. However, the specified value may be set to a value such that the base request value α0(n) calculated in the processing of S36*a* can become less than the specified value or can become equal to or greater than the specified value.

"Restriction Processing"

For example, as described in "Dither Control Processing", in a case where the number of rich combustion cylinders and the number of lean combustion cylinders are the same, instead of the processing of S22, determination may be made whether or not "Qd·(1−α0)" is equal to or greater than the minimum injection amount Qmin. In this case, the number of lean combustion cylinders may be increased greater than the number of rich combustion cylinders under a condition that "Qd·(1−α0)" is less than the minimum injection amount Qmin. In other words, the dither control where the number of rich combustion cylinders and the number of lean combustion cylinders are the same may be restricted, and the dither control where the number of lean combustion cylinders is increased may be examined. In this case, for example, when change is made such that the number of rich combustion cylinders is one and the number of lean combustion cylinders is three as in the embodiments, the processing of S22 may be performed again before the dither control is actually executed, and in a case where determination is made to be affirmative in the processing of S22, the dither control where the number of lean combustion cylinders is increased may be executed. In this case, in a case where determination is made to be negative in the processing of S22, the processing of S36 of FIG. 3 or the processing of S36*a* of FIG. 8 may be performed.

The restriction processing is not limited to processing including the processing for determining whether or not the injection amount obtained by reducing and correcting the requested injection amount Qd is equal to or greater than the minimum injection amount Qmin. For example, in a case where it is assumed that the requested injection amount Qd is included in the parameters for variably setting the base request value α0, and the processing of the S22 is performed, the base request value α0 may be adjusted to a value enough to avoid determination to be negative according to the assumed minimum injection amount Qmin.

"Requested Injection Amount"

In the embodiments, although the value obtained by correcting the base injection amount Qb with the feedback operation amount KAF is set as the requested injection amount Qd that becomes an input for determining whether or not to restrict the dither control, the present disclosure is not limited thereto. For example, in a case where purge control is executed, it is preferable that the requested injection amount Qd is set to a value obtained by subtracting a fuel amount purged in each cylinder. In a case where an injection amount command value is calculated based on a value obtained by correcting the base injection amount Qb with the feedback operation amount KAF and a learning value LAF, it is preferable that the requested injection amount Qd is subjected to correction with the learning value LAF. Incidentally, calculation processing of the learning value LAF is processing for updating the learning value LAF such that a correction factor of the base injection amount Qb with the feedback operation amount KAF decreases with the feedback operation amount KAF as an input. It is preferable that the learning value LAF is stored in an electrically rewritable nonvolatile memory.

"Target Fuel Pressure Variable Processing"

For example, as described in "Others" described below, in a case where a port injection valve is provided, a target value of pressure of fuel injected from the port injection valve may be variably set. Of course, a configuration in which the target value is variably set is not indispensable.

"Fuel Pressure Control Processing"

In the embodiment, although feedback control of pressure of fuel to target fuel pressure is executed, the present disclosure is not limited thereto, and for example, pressure of fuel may be controlled in an open loop.

"Minimum Injection Amount"

In the embodiment, although the minimum injection amount Qmin is calculated based on the fuel pressure PF, the present disclosure is not limited thereto, and for example, the minimum injection amount Qmin may be calculated based on the target fuel pressure PF*.

"Catalyst to be Temperature Increase Target"

The catalyst to be a temperature increase target is not limited to the three-way catalyst 24. For example, a gasoline particulate filter (GPF) including a three-way catalyst may be provided. Here, in a case where the GPF is provided downstream of the three-way catalyst 24, the GPF may be increased in temperature using oxidation heat in oxidizing a non-combustible fuel component or an incomplete combustion component of a rich combustion cylinder with oxygen of a lean combustion cylinder in the three-way catalyst 24. In a case where there is no catalyst having oxygen storage ability upstream of the GPF, it is preferable that the GPF is provided with a catalyst having oxygen storage ability.

"Temperature Increase Request of Catalyst"

The temperature increase request of the catalyst is not limited to that illustrated in the embodiments. For example, in a case of an operation region (for example, an idling operation region) where sulfur is easily deposited in the three-way catalyst 24, a temperature increase request of the catalyst may be issued. As described in "Catalyst to be Temperature Increase Target", in a case where the internal combustion engine 10 including the GPF is adapted as a control target, a temperature increase request of the catalyst through the dither control may be issued in order to combust a particulate substance in the GPF.

"Control Device"

The control device is not limited to the control device that includes the CPU 42 and the ROM 44, and performs software processing. For example, a dedicated hardware circuit (for example, Application Specific Integrated Circuit (ASIC) or the like) that hardware-processes at least a part of the processing subjected to software processing in the embodiments may be provided. That is, the control device may have a configuration of (a) to (c) described below. (a) A processing device that performs the entire processing according to a program, and a program storage device such as a ROM that stores the program are provided. (b) A processing device that performs a part of the processing according to a program, a program storage device, and a dedicated hardware circuit that performs the remaining processing are provided. (c) A dedicated hardware circuit that performs the entire processing is provided. Here, a plurality of software processing circuits each including the processing device and the program storage device or a plurality of dedicated hardware circuits may be provided. That is, the processing may be performed by a processing circuit including at least one of one or a plurality of software processing circuits and one or a plurality of dedicated hardware circuits.

"Internal Combustion Engine"

The internal combustion engine is not limited to a four-cylinder internal combustion engine. For example, the internal combustion engine may be an in-line six-cylinder internal combustion engine. For example, the internal combustion engine may be a V type internal combustion engine that includes a first catalyst and a second catalyst, and has different cylinders where exhaust gas is processed by the first catalyst and the second catalyst.

Others

The fuel injection valve is not limited to a cylinder injection valve that injects fuel to the combustion chamber 16, and for example, may be a port injection valve. The fuel injection valve is not limited to that including an electromagnetic valve, and may be a piezoelectric injector that open and closes a valve body (nozzle needle) with a piezoelectric element. A configuration in which air-fuel ratio feedback control is performed at the time of the execution of the dither control is not indispensable.

What is claimed is:

1. A control device for an internal combustion engine, the internal combustion engine including a plurality of cylinders, and fuel injection valves respectively provided in the cylinders, the control device comprising an electronic control unit programmed to:

calculate an injection amount requested for controlling an exhaust gas air-fuel ratio of each of the cylinders to a target air-fuel ratio, perform dither control processing for controlling the respective fuel injection valve of each of the cylinders based on the requested injection amount such that at least one cylinder of the plurality of cylinders becomes a lean combustion cylinder having an air-fuel ratio leaner than a stoichiometric air-fuel ratio, and at least one of the remaining cylinders of the plurality of cylinders becomes a rich combustion cylinder having an air-fuel ratio richer than the stoichiometric air-fuel ratio, the dither control processing including:

setting a request value that determines a reduction correction amount with respect to the requested injection amount of a fuel injection amount for each lean combustion cylinder and an increase correction amount with respect to the requested injection amount of a fuel injection amount for each rich combustion cylinder, causing a respective fuel injection valve to inject fuel into each lean combustion cylinder with an injection amount obtained by reducing and correcting the requested injection amount based on the reduction correction amount, causing a respective fuel injection valve to inject fuel into each rich combustion cylinder with an injection amount obtained by increasing and correcting the requested injection amount based on the increase correction amount, and controlling an average value of an exhaust gas air-fuel ratio of each rich combustion cylinder and an exhaust gas air-fuel ratio of each lean combustion cylinder for a predetermined period to the target air-fuel ratio, determine whether or not an injection amount obtained by reducing and correcting the requested injection amount based on the reduction correction amount is equal to or greater than a minimum injection amount, and restrict the dither control processing such that an air-fuel ratio of a cylinder having a leanest air-fuel ratio among the cylinders decreases in a case where the injection amount obtained by reducing and correcting the requested injection amount based on the reduction correction amount is equal to or greater than the minimum injection amount.

2. The control device according to claim 1, wherein the electronic control unit is programmed to selectively prohibit the dither control processing.

3. The control device according to claim 1, wherein the electronic control unit is programmed to, in a case where the requested injection amount is less than the minimum injection amount, restrict an injection amount of each respective fuel injection valve configured to allow fuel to be supplied to a lean combustion cylinder to a value equal to or greater than the minimum injection amount.

4. The control device according to claim 3, wherein:

the electronic control unit is programmed to in a case where an injection amount obtained by reducing and correcting the requested injection amount based on the reduction correction amount becomes less than the minimum injection amount, reduce an exhaust gas air-fuel ratio of each lean combustion cylinder and increase an exhaust gas air-fuel ratio of each rich combustion cylinder such that an injection amount of the fuel injection valve configured to allow fuel to be supplied to the lean combustion cylinder becomes equal to or greater than the minimum injection amount.

5. The control device according to claim 1, wherein the electronic control unit is configured to set the minimum injection amount to an injection amount that is smaller in a case where pressure of fuel injected by the fuel injection valve is lower than in a case where pressure of fuel injected is higher.

* * * * *